US011535806B2

(12) United States Patent
Obrecht

(10) Patent No.: US 11,535,806 B2
(45) Date of Patent: Dec. 27, 2022

(54) LUBRICATING COMPOSITION FOR PREVENTING OR REDUCING PRE-IGNITION IN AN ENGINE

(71) Applicant: TOTAL MARKETING SERVICES, Puteaux (FR)

(72) Inventor: Nicolas Obrecht, Sainte Foy lès Lyon (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 17/433,350

(22) PCT Filed: Feb. 21, 2020

(86) PCT No.: PCT/EP2020/054603
§ 371 (c)(1),
(2) Date: Aug. 24, 2021

(87) PCT Pub. No.: WO2020/173824
PCT Pub. Date: Sep. 3, 2020

(65) Prior Publication Data

US 2022/0049177 A1 Feb. 17, 2022

(30) Foreign Application Priority Data

Feb. 25, 2019 (FR) ..... 1901886

(51) Int. Cl.

| | |
|---|---|
| ***C10M 129/20*** | (2006.01) |
| ***C10M 133/20*** | (2006.01) |
| ***C10M 133/42*** | (2006.01) |
| ***C10M 169/06*** | (2006.01) |
| *C10N 40/25* | (2006.01) |

(52) U.S. Cl.
CPC ..... *C10M 129/20* (2013.01); *C10M 133/20* (2013.01); *C10M 133/42* (2013.01); *C10M 169/06* (2013.01); *C10M 2207/044* (2013.01); *C10M 2215/102* (2013.01); *C10M 2215/222* (2013.01); *C10N 2040/252* (2020.05); *C10N 2040/255* (2020.05)

(58) Field of Classification Search
CPC ..... C10M 129/20; C10M 129/24; C10M 2203/1025; C10M 2207/044; C10M 2207/08; C10M 2209/103; C10M 2215/042; C10M 2215/0813; C10M 2215/222; C10M 2215/224; C10M 133/08; C10M 145/20; C10N 2230/76; C10N 2240/104; C10N 2040/252
See application file for complete search history.

(56) References Cited

U.S. PATENT DOCUMENTS

| | | | | |
|---|---|---|---|---|
| 2,812,320 | A | 11/1957 | Beare | |
| 3,254,027 | A | 5/1966 | Matson et al. | |
| 3,294,750 | A | 12/1966 | Baccaredda et al. | |
| 2008/0032913 | A1* | 2/2008 | Finke | C10M 129/24 512/6 |
| 2012/0110899 | A1* | 5/2012 | Beilfuss | C09K 15/30 44/334 |

FOREIGN PATENT DOCUMENTS

| | | | |
|---|---|---|---|
| WO | 2015/023559 | A1 | 2/2015 |
| WO | 2017/021521 | A1 | 2/2017 |
| WO | 2017/021523 | A1 | 2/2017 |

OTHER PUBLICATIONS

International Search Report and Written Opinion for counterpart Application No. PCT/EP2020/054603, dated May 26, 2020.

Hirano et al., "Investigation of Engine Oil Effect on Abnormal Combustion in Turbocharged Direct Injection—Spark Ignition Engines (Part 2)," SAE Technical Paper, doi: 10.4271/2013-01-2569, published Oct. 14, 2013, pp. 1-8.

Kuwahara, Kazunari et al., "Impact of Formaldehyde Addition on Auto-Ignition in Internal-Combustion Engines," JSME International Journal, Series B, Fluids and Thermal Engineering, vol. 48, No. 4, Jan. 1, 2005, pp. 708-716.

Takeuchi, Kazuo et al., "Investigation of Engine Oil Effect on Abnormal Combustion in Turbocharged Direct Injection—Spark Ignition Engines," SAE Int. J. Fuels Lubr., doi: 10.4271/2012-01-1615, vol. 5, Issue 3, (Nov. 2012), pp. 1017-1024.

* cited by examiner

*Primary Examiner* — Vishal V Vasisth
(74) *Attorney, Agent, or Firm* — The Marbury Law Group, PLLC

(57) ABSTRACT

The present invention relates to a lubricating composition for an engine, in particular for a motor vehicle engine, comprising at least one base oil and at least one compound able to release formaldehyde under the temperature and pressure conditions of the combustion chamber of the engine.

It also relates to the use, in a lubricating composition intended for an engine, of a compound able to release formaldehyde under the temperature and pressure conditions of the combustion chamber of the engine, as an additive for preventing and/or reducing pre-ignition, in particular low-speed pre-ignition (LSPI).

13 Claims, No Drawings

LUBRICATING COMPOSITION FOR PREVENTING OR REDUCING PRE-IGNITION IN AN ENGINE

CROSS REFERENCE TO RELATED APPLICATION

This is a national stage application of PCT/EP2020/054603, filed internationally on Feb. 21, 2020, which claims priority to French Application No. 1901886, filed on Feb. 25, 2019, both of which are incorporated by reference herein in their entireties.

TECHNICAL FIELD

The present invention relates to the field of lubricants, which may notably be used in vehicle engines, in particular lubricating compositions for preventing or reducing pre-ignition in an engine.

Under ideal conditions, normal combustion in a spark ignition engine takes place when a mixture of combustible, and notably of fuel and air, is ignited in the combustion chamber inside the cylinder via the production of a spark coming from a spark plug. Such normal combustion is generally characterized by the expansion of the flame front through the combustion chamber in an ordered and controlled manner.

However, in certain cases, the air/fuel mixture may be prematurely ignited by an ignition source before the ignition by the spark from the spark plug, which leads to a phenomenon known as pre-ignition.

Now, it is preferable to reduce or even eliminate pre-ignition since this generally results in the presence of a large increase in the temperature and pressure in the combustion chamber, and thus have a significant negative impact on the efficiency and overall performance of an engine. Furthermore, pre-ignition may cause significant damage to the cylinders, pistons, spark plugs and valves in the engine and in certain cases may even result in an engine failure, or even engine destruction.

More recently, low-speed pre-ignition (LSPI) has been identified, notably by automobile manufacturers, as a potential problem for downsized engines, LSPI generally takes place at low speeds and high loads and may lead to serious damage to the pistons and/or to the cylinders.

PRIOR ART

Several theories have been put forward in an attempt to explain this complex phenomenon. It has notably been observed that the presence of small amounts of lubricant in the combustion chamber, mixing with the fuel, can aggravate pre-ignition. Also, it has been possible to establish a link between the presence of a deposit in the combustion chamber and the occurrence of LSPI phenomena. Lastly, the design of the engine itself may have an influence on pre-ignition.

Thus, this phenomenon proves to be very complex and difficult to predict. As stated above, the nature of the lubricant contributes greatly thereto; lubricating compositions which can prevent or reduce the risk of pre-ignition, in particular LSPI, have thus already been proposed.

To this end, solutions have been described consisting of reducing the content of calcium or increasing the content of zinc dithiophosphate or molybdenum dithiocarbamate in a lubricant (Takeuchi et al., "*Investigation of Engine Oil Effect on Abnormal Combustion in Turbocharged Direct Infection—Spark Ignition Engines*," SAE Int. J. Fuels Lubr. 5(3):1017-1024, 2012; Hirano et al., "*Investigation of Engine Oil Effect on Abnormal Combustion in Turbocharged Direct Injection—Spark Ignition Engines* (*Part* 2)" SAE Technical Paper 2013-01-2569, 2013). However, these solutions are currently still inadequate for significantly reducing pre-ignition, and difficult to implement, in particular in countries where a significant level of basicity of fuels is required. Moreover, these solutions are associated with problems of lubricant stability or of compatibility with after-treatment systems.

Mention may also be made of the document WO 2015/023559, which describes a method for reducing pre-ignition by adding, to a lubricating composition, an additive making it possible to retard ignition, chosen from organic compounds comprising at least one aromatic ring. However, these light organic compounds are liable to lead to an excessive increase in volatility of the lubricant.

For preventing or reducing pre-ignition in a vehicle engine, documents WO 2017/021521 and WO 2017/021523 also propose adding, to a lubricating composition, a polyalkylene glycol or else an organomolybdenum compound chosen from molybdenum dithiophosphates and sulfur-free molybdenum complexes.

SUMMARY OF THE INVENTION

The aim of the present invention is that of proposing a novel lubricating composition making it possible to prevent or reduce pre-ignition in an engine, preferably in a vehicle engine, in particular a motor vehicle engine.

The present invention thus relates, according to a first of its aspects, to a lubricating composition intended for an engine, in particular a motor vehicle engine, comprising at least one base oil and at least one compound able to release formaldehyde ($CH_2O$) under the temperature and pressure conditions of the combustion chamber of the engine.

Preferably, said compound(s) able to release formaldehyde are present in the lubricating composition in a content ranging from 0.2% to 5% by mass relative to the total mass of said composition.

The publication from Kuwahara et al. (*Impact of Formaldehyde Addition on Auto-Ignition in Internal-Combustion Engines*, JSME International Journal, 48(4), 2005, pp. 708-716) presents a study of the influence, on the auto-ignition of an air-fuel mixture, of the injection of formaldehyde into the intake air in a direct-injection spark-ignition engine model. However, this document does not at all concern the problem of low-speed pre-ignition (LSPI) and even less so the formulation of engine lubricating compositions.

To the knowledge of the inventors, it has not once been proposed to employ, in a lubricating composition for an engine, a compound able to release formaldehyde, such as, in particular, trioxane.

As illustrated in the following example, the inventors have found that the addition in accordance with the invention, to a lubricating composition for an engine, of a compound able to release formaldehyde at the combustion chamber of the engine, in particular like trioxane, makes it possible for the lubricating composition to prevent and reduce the pre-ignition phenomenon once it is employed in an engine.

In particular, the addition of such a compound can lead to significantly improved performance in terms of LSPT reduction.

The performance in terms of LSPI reduction may be more particularly evaluated by counting the number of LSPI events according to the protocol detailed in the examples.

The invention also relates, according to another of its aspects, to the use, in a lubricating composition intended for an engine, preferably a vehicle engine, in particular a motor vehicle engine, of a compound able to release formaldehyde under the temperature and pressure conditions of the combustion chamber of the engine, as an additive for preventing and/or reducing pre-ignition, in particular low-speed pre-ignition (LSPI).

It is also directed to the use of a lubricating composition for an engine as described previously, for preventing and/or reducing pre-ignition, in particular low-speed pre-ignition, in an engine, in particular in a vehicle engine, especially a motor vehicle engine.

In the continuation of the text, the term "compounds able to release formaldehyde" or "formaldehyde precursor compounds" will be used to more simply denote compounds, distinct from formaldehyde, which are able to generate formaldehyde under the temperature and pressure conditions encountered in the combustion chamber of the engine. These compounds are described more particularly in the continuation of the text.

According to a particular embodiment, such a compound may be 1,3,5-trioxane.

For the purposes of the present invention, the term "motor vehicle" is intended to denote a vehicle comprising at least one wheel, preferably at least two wheels, propelled by an engine, notably a combustion engine, in particular a reciprocating-piston or rotary-piston internal combustion engine, and more particularly a diesel or spark-ignition engine. Such engines may be, for example, two-stroke or four-stroke gasoline engines.

Advantageously, a lubricating composition according to the invention has both good stability and good pre-ignition-preventing and/or -reducing properties once employed in an engine.

Advantageously, a lubricating composition according to the invention has good pre-ignition-preventing and/or -reducing properties once employed in an engine, without requiring the employment of one or more other technical solutions such as described above which have been proposed to date for preventing or reducing pre-ignition, such as in particular reducing the content of calcium or employing aromatic compounds.

In addition, the use of a formaldehyde precursor compound according to the invention does not have an impact on the lubrication properties of the composition.

Lastly, advantageously, the formulation of a lubricating composition according to the invention is easy to implement.

A further subject of the invention is a process for preventing and/or reducing pre-ignition, in particular low-speed pre-ignition, in an engine, preferably in a vehicle engine, in particular a motor vehicle engine, comprising at least one step of contacting a mechanical part of the engine with a lubricating composition according to the invention as defined above.

Other characteristics, alternative forms and advantages of employing formaldehyde precursors in engine lubricating compositions will emerge more clearly on reading the description and the examples which will follow, given by way of illustration and without limitation of the invention.

In the continuation of the text, the expressions "between . . . and . . . ", "ranging from . . . to . . . " and "varying from . . . to . . . " are equivalent and are intended to mean that the limits are included, unless otherwise mentioned.

Unless otherwise indicated, the expression "comprising a" or "comprising an" should be understood as "comprising at least one".

DETAILED DESCRIPTION

Formaldehyde Precursor Compound

As specified above, a lubricating composition used according to the invention comprises at least one compound able to release formaldehyde ($CH_2O$) under the temperature and pressure conditions of the combustion chamber of the engine.

Those skilled in the art are quite capable of choosing a formaldehyde precursor compound according to the invention, making it possible to generate formaldehyde under the conditions of the combustion chamber of the engine in which the lubricating composition is intended to be employed.

More particularly, the temperature in the combustion chamber of an engine can be greater than or equal to 200° C., in particular between 250° C. and 800° C. and especially between 300° C. and 600° C.

As for the pressure within the combustion chamber, this can vary from $5\times10^4$ Pa to $40\times10^5$ Pa, in particular from $4\times10^5$ Pa to $35\times10^5$ Pa.

A formaldehyde precursor compound according to the invention can thus more particularly be able to generate/release formaldehyde, by thermal decomposition, under conditions of temperature greater than or equal to 200° C. and of pressure of greater than or equal to $4\times10^5$ Pa.

As examples of formaldehyde precursor compounds mention may in particular be made of N-methylol compounds, such as dimethylolurea, trimethylolurea, dimethylolguanidine, trimethylolmelamine, hexamethylolmelamine or else 1,3,5,5-tetramethylimidazolidine-2,4-dione; guanidine acetate; formaldehyde sodium bisulfite; methenamine (or hexamethylenetetramine); polymerized forms of formaldehyde, such as paraformaldehyde; trioxanes, in particular 1,3,5-trioxane, 1,2,4-trioxane and trioxane derivatives.

In particular, the formaldehyde precursor compounds may be chosen from N-methylol compounds, such as dimethylolurea, trimethylolurea, dimethylolguanidine, trimethylolmelamine, hexamethylolmelamine or else 1,3,5,5-tetramethylimidazolidine-2,4-dione; formaldehyde sodium bisulfite; methenamine; polymerized forms of formaldehyde, such as paraformaldehyde; trioxanes, in particular 1,3,5-trioxane and trioxane derivatives.

According to a particular embodiment, the formaldehyde precursor compound required according to the invention is chosen from methenamine, paraformaldehyde and trioxanes, in particular 1,3,5-trioxane.

Preferably, the formaldehyde precursor according to the invention is a trioxane, in particular 1,3,5-trioxane.

The formaldehyde precursor compounds required according to the invention may be commercially available or else prepared according to synthesis methods known to those skilled in the art, in particular from formaldehyde.

For example, trioxane can be produced by trimerization of formaldehyde employing acid catalysts.

It is understood that within the context of the present invention a formaldehyde precursor can be in the form of a mixture of different formaldehyde precursors, in particular as defined above.

In general, the formaldehyde precursor compound(s) according to the invention can be employed as additive in a lubricating composition for an engine at an amount of from 0.2% to 5% by mass, preferably of from 0.5% to 2.5% by mass, and in particular of around 1% by mass, relative to the total mass of said lubricating composition.

Lubricating Composition

Said formaldehyde precursor compound(s) according to the invention are employed as additives in a lubricating composition for an engine, in particular for a vehicle engine, especially a motor vehicle engine.

Base Oil

A lubricating composition for an engine according to the invention comprises at least one base oil.

These base oils may be chosen from the base oils conventionally used in the field of engine lubricating oils, such as mineral, synthetic or natural, animal or plant, oils.

It may be a mixture of several base oils, for example a mixture of two, three or four base oils.

The base oils of the lubricating compositions that are considered according to the invention may in particular be oils of mineral or synthetic origin, belonging to groups I to V according to the classes defined in the API classification (or their equivalents under the ATIEL classification) and presented in table 1 below.

The API classification is defined in American Petroleum Institute 1509 "Engine Oil Licensing and Certification System", 17th edition, September 2012.

The ATIEL classification is defined in "The ATIEL Code of Practice", number 18, November 2012.

TABLE 1

| | Content of saturates | Sulfur content | Viscosity index |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked of hydroisomerized oils | ≥90% | ≤0.03% | ≥120 |
| Group IV | PAOs (poly-alpha-olefins) | | |
| Group V | Esters and other bases not included in groups I to IV | | |

There is generally no limit as regards the use of different base oils for preparing a lubricating composition used according to the invention, apart from the fact that they must have properties, notably in terms of viscosity, viscosity index, sulfur content or oxidation resistance, that are suitable for use in engines, in particular vehicle engines.

The mineral base oils include any type of base obtained by atmospheric and vacuum distillation of crude oil, followed by refining operations such as solvent extraction, deasphalting, solvent dewaxing, hydrotreating, hydrocracking, hydroisomerization and hydrofinishing.

The synthetic base oils may be chosen from esters, silicones, glycols, polybutene, poly-alpha-olefins (PAOs), alkylbenzene or alkylnaphthalene. The poly-alpha-olefins used as base oils are for example obtained from monomers comprising 4 to 32 carbon atoms, for example from octene or decene, and the viscosity of which at 100° C. is between 1.5 and 15 $mm^2/s$ according to the standard ASTM D445. Their average molecular mass is generally between 250 and 3000 according to the standard ASTM D5296.

The base oils may also be oils of natural origin, for example esters of alcohols and of carboxylic acids, which may be obtained from natural resources, such as sunflower oil, rapeseed oil, palm oil, soy bean oil, etc.

The base oil may be chosen more particularly from synthetic oils, mineral oils and mixtures thereof.

According to one embodiment, a lubricating composition employed according to the present invention comprises at least one base oil chosen from oils of group 111, oils of group IV, and mixtures thereof.

In particular, a lubricating composition according to the invention may comprise at least one base oil of group III.

A lubricating composition used according to the invention may comprise at least 50% by mass of base oil(s) relative to the total mass of the composition.

Advantageously, a lubricating composition used according to the invention comprises at least 60% by mass, or even at least 70% by mass, of base oil(s) relative to the total mass of the composition.

More particularly advantageously, a lubricating composition used according to the invention comprises from 60% to 99.5% by mass of base oil(s), preferably from 70% to 95% by mass of base oil(s), relative to the total mass of the composition.

Additives

Numerous additives, distinct from the formaldehyde precursor compounds described above, can also be employed in an engine lubricating composition according to the invention.

The additives which can be incorporated into a composition according to the invention can be chosen from antioxidants, detergents, viscosity index improvers, friction modifiers, antiwear additives, extreme pressure additives, dispersants, pour point improvers, antifoams, thickeners, and mixtures thereof.

Preferably, a lubricating composition used according to the invention comprises at least one additive chosen from antiwear additives, antioxidant additives, viscosity index improver additives, detergents, dispersants, and mixtures thereof.

According to a particular embodiment, a lubricating composition according to the invention comprises an antiwear additive and/or an antioxidant additive, preferably in a total amount ranging from 0.5% to 8% by mass, relative to the total mass of the lubricating composition.

It is understood that the nature and the amount of the additives employed are chosen so as not to affect the properties of the lubricating composition, in particular the performance of the composition in terms of reducing LSPI.

These additives may be introduced individually and/or in the form of a mixture, generally referred to as an "additive package", such as those already available for sale for commercial lubricant formulations for vehicle engines, with a performance level as defined by the ACEA (Association des Constructeurs Européens d'Automobiles or European Automobile Manufacturers' Association) and/or the API (American Petroleum Institute), which are well known to those skilled in the art.

According to a particular embodiment, a lubricating composition according to the invention can also comprise at least one antioxidant additive.

The antioxidant additive generally makes it possible to retard the degradation of the composition in service. This degradation may notably be reflected by the formation of deposits, the presence of sludges, or an increase in the viscosity of the composition. The antioxidant additives notably act as free-radical inhibitors or hydroperoxide destroyers.

Among the commonly used antioxidant additives, mention may be made of antioxidant additives of phenolic type, antioxidant additives of amine type and phospho-sulfur-based antioxidant additives. Some of these antioxidant additives, for example the phospho-sulfur-based antioxidant additives, may be ash generators. The phenolic antioxidant additives may be ash-free or may be in the form of neutral or basic metal salts.

The antioxidant additives may notably be chosen from sterically hindered phenols, sterically hindered phenol esters and sterically hindered phenols comprising a thioether bridge, diphenylamines, diphenylamines substituted with at least one $C_1$-$C_{12}$ alkyl group, N,N'-dialkyl-aryl-diamines, and mixtures thereof.

Preferably according to the invention, the sterically hindered phenols are chosen from compounds comprising a phenol group, in which at least one carbon vicinal to the carbon bearing the alcohol function is substituted with at least one $C_1$-$C_{10}$ alkyl group, preferably a $C_1$-$C_6$ alkyl group, preferably a $C_4$ alkyl group, preferably with a tert-butyl group.

Amine compounds are another class of antioxidant additives that may be used, optionally in combination with the phenolic antioxidant additives.

Examples of amine compounds are aromatic amines, for example the aromatic amines of formula $NR^4R^5R^6$ in which $R^4$ represents an optionally substituted aliphatic or aromatic group, $R^5$ represents an optionally substituted aromatic group. $R^6$ represents a hydrogen atom, an alkyl group, an aryl group or a group of formula $R'S(O)_zR^8$ in which $R^7$ represents an alkylene group or an alkenylene group, $R^8$ represents an alkyl group, an alkenyl group or an aryl group and z represents 0, 1 or 2.

Sulfurized alkylphenols or the alkali metal or alkaline-earth metal salts thereof may also be used as antioxidant additives.

Another class of antioxidant additives is that of copper compounds, for example copper thiophosphates or dithiophosphates, copper salts of carboxylic acids, and copper dithiocarbainates, sulfonates, phenates and acetylacetonates. Copper I and II salts and succinic acid or anhydride salts may also be used.

A lubricating composition according to the invention may contain any type of antioxidant additive known to those skilled in the art.

Advantageously, a lubricating composition according to the invention comprises at least one antioxidant additive chosen from diphenylamine, phenols, phenol esters and mixtures thereof.

A lubricating composition according to the invention may comprise from 0.05% to 2% by mass, preferably from 0.5% to 1% by mass, of at least one antioxidant additive, relative to the total mass of the composition.

According to another embodiment, a composition according to the invention may also comprise at least one detergent additive.

The detergent additives generally make it possible to reduce the formation of deposits on the surface of metal parts by dissolving the oxidation and combustion byproducts.

The detergent additives that may be used in a composition employed according to the invention are generally known to those skilled in the art. The detergent additives may be anionic compounds comprising a long lipophilic hydrocarbon-based chain and a hydrophilic head. The associated cation may be a metal cation of an alkali metal or an alkaline-earth metal.

The detergent additives are preferentially chosen from alkali metal or alkaline-earth metal salts of carboxylic acids, sulfonates, salicylates and naphthenates, and also phenate salts. The alkali metals and alkaline-earth metals are preferentially calcium, magnesium, sodium or barium.

These metal salts generally comprise the metal in a stoichiometric amount or in excess, thus in an amount greater than the stoichiometric amount. They are then overbased detergent additives; the excess metal giving the overbased nature to the detergent additive is then generally in the form of a metal salt that is insoluble in the oil, for example a carbonate, a hydroxide, an oxalate, an acetate or a glutamate, preferentially a carbonate.

A lubricating composition according to the invention may contain any type of detergent additive known to those skilled in the art.

Advantageously, a lubricating composition according to the invention comprises at least one detergent additive chosen from alkaline-earth metal salts, preferably from calcium salts, magnesium salts, and mixtures thereof.

In particular, when the detergent is chosen from alkaline-earth metal salts, the detergent additive may be added to the composition so as to supply a content of metal element ranging from 150 ppm to 2000 ppm, preferably from 250 ppm to 1500 ppm.

According to yet another embodiment, a lubricating composition according to the present invention may also comprise a viscosity index improver additive.

As examples of viscosity index improver additives, mention may be made of polymeric esters, hydrogenated or non-hydrogenated homopolymers or copolymers of styrene, butadiene and isoprene, polyacrylates, polymethacrylates (PMAs) or olefin copolymers, notably ethylene/propylene copolymers.

Advantageously, a lubricating composition according to the invention comprises at least one viscosity index improver additive chosen from hydrogenated or non-hydrogenated homopolymers or copolymers of styrene, butadiene and isoprene. Preferably, it is a hydrogenated styrene/isoprene copolymer.

A lubricating composition according to the invention may for example comprise from 2% to 15% by mass of viscosity index improver additive, relative to the total mass of the composition.

The antiwear additives and the extreme pressure additives protect the friction surfaces by forming a protective film adsorbed onto these surfaces.

A wide variety of antiwear additives exists. Preferably, for the lubricating composition according to the invention, the antiwear additives are chosen from phospho-sulfur-based additives, such as metal alkylthiophosphates, in particular zinc alkylthiophosphates and more specifically zinc dialkyldithiophosphates or ZnDTP. The preferred compounds are of formula $Zn((SP(S)(OR^2)(OR^3))_2$, in which $R^2$ and $R^3$, which may be identical or different, independently represent an alkyl group, preferentially an alkyl group including from 1 to 18 carbon atoms.

Amine phosphates are also antiwear additives that may be used in a composition according to the invention. However, the phosphorus introduced by these additives may act as a poison for the catalytic systems of automobiles since these additives are ash generators. These effects can be minimized by partially replacing the amine phosphates with additives which do not introduce phosphorus, for instance polysulfides, notably sulfur-based olefins.

A lubricating composition according to the invention may comprise from 0.01% to 6% by mass, preferentially from 0.05% to 4% by mass, more preferentially from 0.1% to 2% by mass, of antiwear additives and extreme pressure additives, relative to the total mass of the composition.

A lubricating composition according to the invention is preferably free of antiwear additives and of extreme pressure additives. In particular, a lubricating composition according to the invention may be free of phosphate-based additives.

A lubricating composition according to the invention may comprise at least one friction modifier additive. The friction modifier additive may be chosen from a compound providing metal elements and an ash-free compound. Among the compounds providing metal elements, mention may be made of complexes of transition metals such as Mo, Sb, Sn, Fe, Cu or Zn, the ligands of which may be hydrocarbon-based compounds comprising oxygen, nitrogen, sulfur or phosphorus atoms. Mention may for example be made of friction modifiers of molybdenum dithiocarbamate type. The ash-free friction modifier additives are generally of organic origin and may be chosen from fatty acid monoesters of polyols, alkoxylated amines, alkoxylated fatty amines, fatty epoxides, borate fatty epoxides, fatty amines or fatty acid esters of glycerol. According to the invention, the fatty compounds comprise at least one hydrocarbon-based group comprising from 10 to 24 carbon atoms. A lubricating composition according to the invention may comprise from 0.01% to 2% by mass or from 0.01% to 5% by mass, preferentially from 0.1% to 1.5% by mass or from 0.1% to 2% by mass, of friction modifier additive, relative to the total mass of the composition.

A lubricating composition according to the invention may also comprise at least one pour-point depressant additive.

By slowing down the formation of paraffin crystals, the pour-point depressant additives generally improve the cold-temperature behavior of the composition.

Examples of pour-point depressant additives that may be mentioned include polyalkyl methacrylates, polyacrylates, polyarylamides, polyalkylphenols, polyalkynaphthalenes and polyalkylstyrenes.

Also, a lubricating composition according to the invention may comprise at least one dispersant.

The dispersant may be chosen from Mannich bases, succinimides and derivatives thereof.

A lubricating composition according to the invention may for example comprise from 0.2% to 10% by mass of dispersant, relative to the total mass of the composition. Preferably, the additives detailed above are introduced into a lubricating composition employed according to the invention in the form of a mixture, or additive package.

According to this embodiment, the additive package may be present in a composition employed according to the invention in a content ranging from 1% to 30% by mass, in particular from 1% to 20% by mass, relative to the total mass of the composition, preferably ranging from 5% to 15% by mass.

According to one embodiment of the invention, a lubricating composition comprises, relative to the total mass of the lubricating composition:

- from 60% to 99.5% by mass of base oil(s), preferably from 70% to 95% by mass of base oil(s);
- from 0.2% to 5% by mass, preferably from 0.5% to 2.5% by mass, of formaldehyde precursor compound(s), such as 1,3,5-trioxane;
- optionally from 1% to 30% by mass, preferably from 5% to 20% by mass, of additive(s) chosen from antiwear agents, antioxidants, detergents, dispersants, viscosity index improvers, and mixtures thereof, preferably from antiwear agents, antioxidants, detergents, dispersants, viscosity index improver additives and mixtures thereof.

A lubricating composition according to the invention may be provided in different forms. It may in particular be an anhydrous composition. Preferably, the lubricating composition according to the invention is not an emulsion.

Applications

As mentioned above, a lubricating composition according to the invention is intended to be employed in an engine, in particular in a vehicle engine.

It thus advantageously has properties, notably in terms of viscosity, viscosity index, sulfur content and oxidation resistance, which are suitable for use in engines, in particular vehicle engines.

Advantageously, a lubricating composition according to the invention makes it possible to prevent and/or reduce phenomena of pre-ignition, in particular low-speed pre-ignition, in an engine.

The term "engine" according to the invention is understood more particularly to mean vehicle engines, such as gasoline engines, engines which run on gas, engines which run on gas and gasoline, and engines which run on gas and diesel fuel.

More particularly, it can relate to:

- motor vehicle engines, including gasoline engines, engines which run on gas and diesel engines, but also engines which run on gas and gasoline (gas/gasoline dual-fuel engines), and also engines which run on gas and diesel fuel (gas/diesel fuel dual-fuel engines);
- heavy-duty vehicle engines, and more specifically heavy-duty vehicle engines which run on gas.

The term "engine" also encompasses four-stroke engines, and more specifically marine four-stroke engines, preferentially marine four-stroke engines which run on gas.

In a preferred embodiment of the invention, the lubricating composition is used to prevent and/or reduce pre-ignition in a vehicle engine, preferably a motor vehicle engine.

The term "pre-ignition" according to the invention includes the low-frequency vibration phenomenon which produces a rumble sound effect.

More particularly, the term "pre-ignition" denotes low-speed pre-ignition (LSPI).

In particular, low-speed pre-ignition phenomena can be exacerbated in direct-injection engines, in particular in "downsized" engines.

All of the characteristics and particular embodiments relating to the formaldehyde precursor compound and to the lubricating composition which are described above also apply to the uses targeted according to the invention.

The invention will now be described by means of the examples that follow, which are, needless to say, given as nonlimiting illustrations of the invention.

EXAMPLE

Example 1: Preparation of the Lubricating Compositions

The reference composition A0, not containing any formaldehyde precursor compound, and the composition according to the invention A1, comprising a formaldehyde precursor compound required according to the invention, were prepared by mixing the various components in the amounts given in table 2 below.

The proportions of the different compounds are indicated as percentages by mass.

TABLE 2

| Composition | A0 | A1 |
|---|---|---|
| Base oil of group III | 75 | 74 |
| VI improver polymer (styrene-butadiene) | 13 | 13 |
| Additive package | 12 | 12 |
| 1,3,5-trioxane | — | 1 |

Example 2: Evaluation of the Pre-Ignition-Reducing Properties of the Lubricating Compositions Evaluation Protocol The pre-ignition-reducing properties of the lubricating compositions are evaluated by evaluating the impact of each lubricating composition on low-speed pre-ignition (LSPI) For this, the LSPI phenomenon is quantified using a GM Ecotec model turbocharged spark-ignition engine composed of four inline cylinders with a total displacement of 2.0 l.

After a 20-minute warm-up period at an engine speed of 2000 rpm and an engine load of $4\times10^5$ pascals of mean effective pressure (MEP), the test procedure consists of 24 high-load sequences ($18\times10^5$ pascals MEP at a speed of 2000 rpm), called "segments". Each segment comprises 25 000 engine cycles to ensure good statistical representation of the phenomenon studied.

Each cylinder is equipped with a sensor allowing measurement of the pressure prevailing in the combustion chamber during engine operation. A high-frequency recorder records the pressure signal, allowing fine analysis of the combustion.

Combustion is considered to be an LSPI event if one of the two following criteria is met:

the maximum pressure of a cycle is greater than the mean of the maximum pressures over the entire sequence considered +4.7 times the standard deviation of the maximum pressure measured over the sequence; or the crankshaft angle at which 2% of the mass of the combustible mixture has burned over a given cycle is less than the mean of the crankshaft angles at which 2% of the mass of combustible mixture has burned over the entire sequence considered plus 4.7 times the standard deviation over the crankshaft angle at which 2% of the mass of combustible mixture has burned over the entire sequence.

For each lubricating composition tested, the sum of the LSPI events is counted over the period of a segment, and then the mean of the LSPI events over all of the 24 segments is calculated. From this mean, an LSPI index is calculated by applying the square root of the sum of the mean of the LSPI events plus 0.5. The impact of the lubricating composition on the LSPI parameter is evaluated by comparing the LSPI index associated with this composition and taking into account the standard deviation calculated over the 24 engine segments.

Result

The number of LSPI phenomena was counted according to the method defined above for each of the reference composition A0 and the composition according to the invention A1. The results are given in table 3 below.

TABLE 3

| Composition | A0 | A1 |
|---|---|---|
| Number of LSPI events | 3.5 +/− 0.4 | 2.6 +/− 0.3 |

The results show that the lubricating composition A1 according to the invention, comprising a compound able to release formaldehyde in the combustion chamber, has improved LSPT-reducing properties compared to a reference lubricating composition A0 not comprising such a formaldehyde precursor compound.

The invention claimed is:

1. A lubricating composition for an engine, comprising:

at least one synthetic base oil; and at least one formaldehyde-releasing compound configured to release formaldehyde under temperature and pressure conditions that occur in a combustion chamber of the engine, during operation of the engine, wherein the lubricating composition comprises from 0.2% to 5% by mass of the at least one formaldehyde-releasing compound, relative to the total mass of the lubricating composition, and wherein the at least one formaldehyde-releasing compound is a trioxane.

2. The lubricating composition according to claim 1, wherein the at least one formaldehyde-releasing compound is chosen from 1,3,5-trioxane, 1,2,4-trioxane, or mixtures thereof.

3. The lubricating composition according to claim 1, wherein the at least one formaldehyde-releasing compound is present in an amount ranging from 0.5% to 2% by mass, relative to the total mass of the lubricating composition.

4. The lubricating composition according to claim 1, wherein the lubricating composition comprises from 60% to 99.5% by mass of the at least one synthetic base oil, relative to the total mass of the lubricating composition.

5. The lubricating composition according to claim 1, further comprising an additional additive chosen from antioxidants, detergents, viscosity index improvers, friction modifiers, antiwear additives, extreme pressure additives, dispersants, pour point improvers, antifoams, thickeners, or mixtures thereof.

6. A method for preventing and/or reducing pre-ignition in an engine comprising:

adding at least one formaldehyde-releasing compound to a lubricating composition comprising at least one synthetic base oil; and lubricating the engine using the lubricating composition, wherein the at least one formaldehyde-releasing compound is configured to release formaldehyde under temperature and pressure conditions that occur in a combustion chamber of the engine during operation of the engine, and wherein the formaldehyde reduces low-speed pre-ignition of the engine, and wherein the at least one formaldehyde-releasing compound is a trioxane.

7. The method according to claim 6, wherein the at least one formaldehyde-releasing compound is present in the lubricating composition in an amount ranging from 0.2% to 5% by mass, relative to the total mass of the lubricating composition.

8. The method according to claim 6, wherein the lubricating composition comprises:

from 60% to 99.5% by mass of the at least one synthetic base oil, relative to the total mass of the lubricating composition; and an additive chosen from antioxidants, detergents, viscosity index improvers, friction modifiers, antiwear additives, extreme pressure additives, dispersants, pour point improvers, antifoams, thickeners, or mixtures thereof.

9. The method according to claim 6, wherein the lubricating the engine comprises preventing and/or reducing pre-ignition during operation of the engine.

10. A method for preventing and/or reducing pre-ignition in an engine, comprising lubricating the engine using a lubricating composition of claim 1.

11. The method as claimed in claim 10, wherein the engine is an engine that runs on gasoline, natural gas, a combination of gasoline and natural gas, diesel fuel, or a combination of natural gas and diesel fuel.

12. The method as claimed in claim 6, wherein the at least one formaldehyde-releasing compound is chosen from 1,3,5-trioxane, 1,2,4-trioxane, or mixtures thereof.

13. The method according to claim 6, wherein the lubricating the engine comprises preventing and/or reducing low-speed pre-ignition during operation of the engine.

* * * * *